US008045906B2

(12) United States Patent
Funabiki

(10) Patent No.: US 8,045,906 B2
(45) Date of Patent: Oct. 25, 2011

(54) BELT-TYPE FIXING DEVICE HAVING A PRESSURE ROLLER WITH SURFACE UNDULATIONS

(75) Inventor: Hiroshi Funabiki, Uenohara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 722 days.

(21) Appl. No.: 12/136,274

(22) Filed: Jun. 10, 2008

(65) Prior Publication Data

US 2009/0016790 A1 Jan. 15, 2009

(30) Foreign Application Priority Data

Jul. 11, 2007 (JP) ..... 2007-182025

(51) Int. Cl.
*G03G 15/20* (2006.01)

(52) U.S. Cl. ..... 399/329; 399/333

(58) Field of Classification Search ..... 399/329, 399/331, 333
See application file for complete search history.

(56) References Cited

U.S. PATENT DOCUMENTS

| | | | | |
|---|---|---|---|---|
| 4,200,389 | A * | 4/1980 | Matsui et al. | 399/333 |
| 6,144,832 | A * | 11/2000 | Nimura et al. | 399/333 |
| 6,668,152 | B1 * | 12/2003 | Jacob | 399/333 |
| 7,447,474 | B2 * | 11/2008 | Fujino | 399/329 |

FOREIGN PATENT DOCUMENTS

| | | |
|---|---|---|
| JP | 5-53467 A | 3/1993 |
| JP | 10-156841 A | 6/1998 |
| JP | 2004-94079 A | 3/2004 |

* cited by examiner

*Primary Examiner* — William J Royer
(74) *Attorney, Agent, or Firm* — Sidley Austin LLP

(57) ABSTRACT

A belt-type fixing device having therein an endless fixing belt, a pressure roller arranged inside the aforesaid fixing belt and a pressure member that presses the fixing belt against the pressure roller, wherein a toner image on a recording material is fixed in a nip portion formed between the fixing belt and the pressure member, and wherein the pressure roller has an elastic layer made of solid rubber, and the elastic layer is covered by a resin layer, and further plural undulations are formed in the circumferential direction of the outer circumferential surface of the pressure roller.

6 Claims, 7 Drawing Sheets

BELT-TYPE FIXING DEVICE HAVING A PRESSURE ROLLER WITH SURFACE UNDULATIONS

This application is based on Japanese Patent Application No. 2007-182025 filed on Jul. 11, 2007 in the Japanese Patent Office, the entire content of which is hereby incorporated by reference.

BACKGROUND OF THE INVENTION

The present invention relates to a belt-type fixing device that fixes a toner image on a recording material by heating and applying pressure to the toner of the toner image, and relates to an image forming apparatus equipped with the belt-type fixing device.

In an image forming apparatus of an electrophotographic type such as a copying machine, a printer, a facsimile machine and a multifunctional machine equipped with the aforesaid various functions, a latent image corresponding to a document is formed on a photoconductor, then, the latent image is supplied with toner to become a visible image, and this visible toner image is transferred onto a recording sheet, and after this, the toner image transferred onto the recording sheet is fixed, and the recording sheet is ejected.

When forming a color image, latent images for Y, M, C and K corresponding to a document are formed respectively on four photoconductor drums, then, visualized four toner images are transferred primarily onto an intermediate transfer body composed of an endless belt, and they are transferred secondarily onto a recording sheet, thus, the toner image transferred onto the recording sheet is fixed and the recording sheet is ejected.

As a fixing device that fixes a toner image in the aforesaid way, there is a fixing device of a belt type wherein there are provided an endless fixing belt wound around a heat roller having therein a heating device such as a halogen heater and further around a pressure roller, and an outer pressure roller that presses the pressure roller through the fixing belt, and wherein the recording sheet onto which the toner image has been transferred is heated and pressed in a nip portion formed by the fixing belt and the outer pressure roller while the recording sheet is interposed and conveyed. A belt-type fixing device of this kind has merit in that the warm-up time is shortened, resulting in energy savings because the fixing belt of a belt-type fixing device of this type has a small heat capacity.

For making fixing at a higher speed possible, in the belt-type fixing device of this kind, it is necessary to secure a great width of a nip portion. Further, for improving an efficiency of separation from a fixing belt, it is necessary to secure a great curvature on a separating portion on the fixing belt. For both of the foregoing matters mentioned above, it is effective to make an elastic layer of a pressure roller to be lower in hardness.

Though low hardness can be obtained easily in the case of sponge, when it is used for the elastic layer of the pressure roller, pressure in a nip becomes uneven and fine uneven gloss is generated in an image to lower image quality, because of uneven density in sponge. In addition, durability of a roller employing sponge is deteriorated.

Solid rubber gives uniform pressure, and it is free from the image quality decline and durability shortage. However, when rubber of low hardness is used, there is caused a problem of a tack property, resulting in high close adhesion and a state similar to adhesion. In the nip portion, a solid rubber layer is squeezed by high load, and a surface of the solid rubber shrinks once before entering the nip portion, and then is extended gradually as the pressure in the nip portion increases, and after that, a progress opposite to the foregoing is taken after passing the maximum pressure area.

On the other hand, a belt basic body is made of a metal like nickel electroformed metal and a high strength heat-resistant resin such as polyimide, and its elastic modulus is greater than that of rubber, and it hardly shows expansion and contraction. Therefore, it is necessary for the inner surface of the fixing belt to slide on the surface of the pressure roller in the nip portion. However, if a tack property is high, both of them cannot slide easily on each other and troubles that they are forced to slide to generate abnormal noises are generated, or the fixing belt yields and wrinkles are caused thereon.

To avoid the foregoing, it is also possible to grind a solid rubber surface of the pressure roller to acquire an appropriate roughness, and thereby, to make it slide easily. However, in the case of low hardness rubber, the rubber easily becomes a large lump when it is torn off by a grindstone, and thereby, the condition for grinding needs to be controlled extremely strictly for obtaining appropriated roughness, and polishing powder and a portion of rubber immediately before being torn off tend to stay on the surface. After being mounted in a fixing device, uneven pressure distribution is caused in the nip portion by the polishing powder and broken pieces. Further, the polishing powder and others are transferred to a fixing belt and a heat roller, to make heat conduction from the heat roller to be uneven, resulting in uneven temperature of the fixing belt. This unevenness in pressure and temperature results in image defect such as uneven gloss. Further, since the surface is still composed of a rubber of low hardness, tack property to some extent still remains, and even when a fixing belt and a pressure roller can be driven, a state where the pressure roller clings to the inner surface of the fixing belt is generated, in the course of assembling a fixing device, resulting in extremely degraded easiness of assembling. In addition, if they are forced to be assembled, the fixing belt is easily damaged.

Therefore, for preventing the tack property on the surface of the pressure roller, it can be considered that the surface of solid rubber provided on the pressure roller is covered or is coated by a tube of PFA (perfluoroalkoxy) or of PTFE (polytetrafluoroethylene) representing resin with low friction. In this structure, sliding property on a fixing belt is improved by a resin layer.

A fixing device wherein a silicone rubber layer of the pressure roller is covered with a PFA tube is known (see Unexamined Japanese Patent Application Publication No. 2004-94079).

A surface roughness corresponding to the use is needed for the surface of an elastic roller used for a copying machine or the like, for securing friction against a recording sheet. However, when the elastic roller is made to be small, lowering the hardness of the elastic layer is necessary, because an elastic layer also becomes thinner. A patent gazette discloses an elastic roller wherein plural fine grooves are formed in the axial direction when producing the elastic roller of this kind, because forming evenly fine undulations on the surface through conventional grinding processing or electrical discharging machining is not possible. Incidentally, forming of the fine grooves is conducted through injection molding employing a mold that is formed from a mother mold made by grinding processing by a grindstone (see Unexamined Japanese Patent Application Publication No. 10-156841).

Further, the patent gazette discloses a thermal fixing roller wherein highly accurate geometric undulations are formed on the surface of an elastic layer for preventing a sheet from coiling (see Unexamined Japanese Patent Application Publication No. 5-53467).

When a resin layer made of PFA or PTFE is formed on the surface of a pressure roller, easiness of sliding on a fixing belt is improved, and no abnormality is caused on rotation of the fixing belt, thereby, neither wrinkles on the recording sheet nor abnormal noises are generated, and a problem that a work efficiency for assembling of a fixing device is lowered is not caused.

However, when a pressure is applied in the nip portion as stated above, a low hardness solid rubber of the pressure roller is crushed, and the surface tends to extend or contract. For obtaining a wide nip portion or a high separation curvature, the solid rubber is transformed greatly, and the elasticity rate without a resin layer becomes to be about ±10%. In the initial state, the resin layer disturbs this transformation and supports, but it cannot support for a long time, because a resin layer is formed as extremely thin as 10-50 μm so that tenderness of the pressure roller may not be deteriorated. Since the resin layer does not have elasticity like that of rubber, the resin layer is gradually expanded while it repeats its passage through the nip portion, and cracks are generated when being expanded. Since there is no support by a resin layer on the portion of the cracks, transformation is concentrated on the rubber layer of that portion, and cracks progress not only on the resin layer but also on the rubber layer. Under such condition, fixing pressure is not applied on the portion of cracks sufficiently, and uneven gloss and fixing troubles are caused. Further it results in damages of the rubber layer in the worst case.

The invention has been achieved in view of the aforesaid problems, and its objective is to propose a belt-type fixing device wherein cracks affecting adversely a resin layer and an elastic layer by pressure in the nip portion are not generated even when an elastic layer of the pressure roller in the belt-type fixing device is covered by a resin layer, and to propose an image forming apparatus equipped with the belt-type fixing device.

Incidentally, Unexamined Japanese Patent Application Publication No. 2004-94079 does not disclose the problem that a PFA tube and a silicone rubber layer are torn, and countermeasures for the problem of this kind is not described at all.

In Unexamined Japanese Patent Application Publication No. 10-156841, only an elastic layer is formed on the outer circumferential surface of a core material in the elastic roller, and fine grooves are formed for causing surface roughness of the elastic layer to be uniform. Therefore, the structure to cover the elastic layer further with a resin layer is not described, and the problems that cracks are caused on the elastic layer and countermeasures for the problems are not described at all.

In the case of Unexamined Japanese Patent Application Publication No. 5-53467, a fixing heat roller is one wherein a geometric undulation forms are provided on the surface of the elastic layer on the core metal member, and the structure for covering the elastic layer further with a resin layer is not described, and it is one for preventing a sheet from clinging to the fixing roller, thus, the problems that cracks are generated on the elastic layer and countermeasures for the problems are not described at all.

SUMMARY

An objective aforementioned is attained by the embodiments of the invention described below.

1. A belt-type fixing device including an endless fixing belt, a pressure roller arranged inside the fixing belt, and a pressure member which presses the fixing belt against the pressure roller, wherein a toner image on a recording material is fixed in a nip portion formed between the fixing belt and the pressure member, and wherein the pressure roller has an elastic layer made of solid rubber, and the elastic layer is covered by a resin layer, and then a plurality of undulations are formed on an outer circumferential surface of the pressure roller in a circumferential direction.

2. An image forming apparatus having the abovementioned belt-type fixing device.

DETAILED DESCRIPTION OF THE PREFERRED EMBODIMENT

Figure 1:
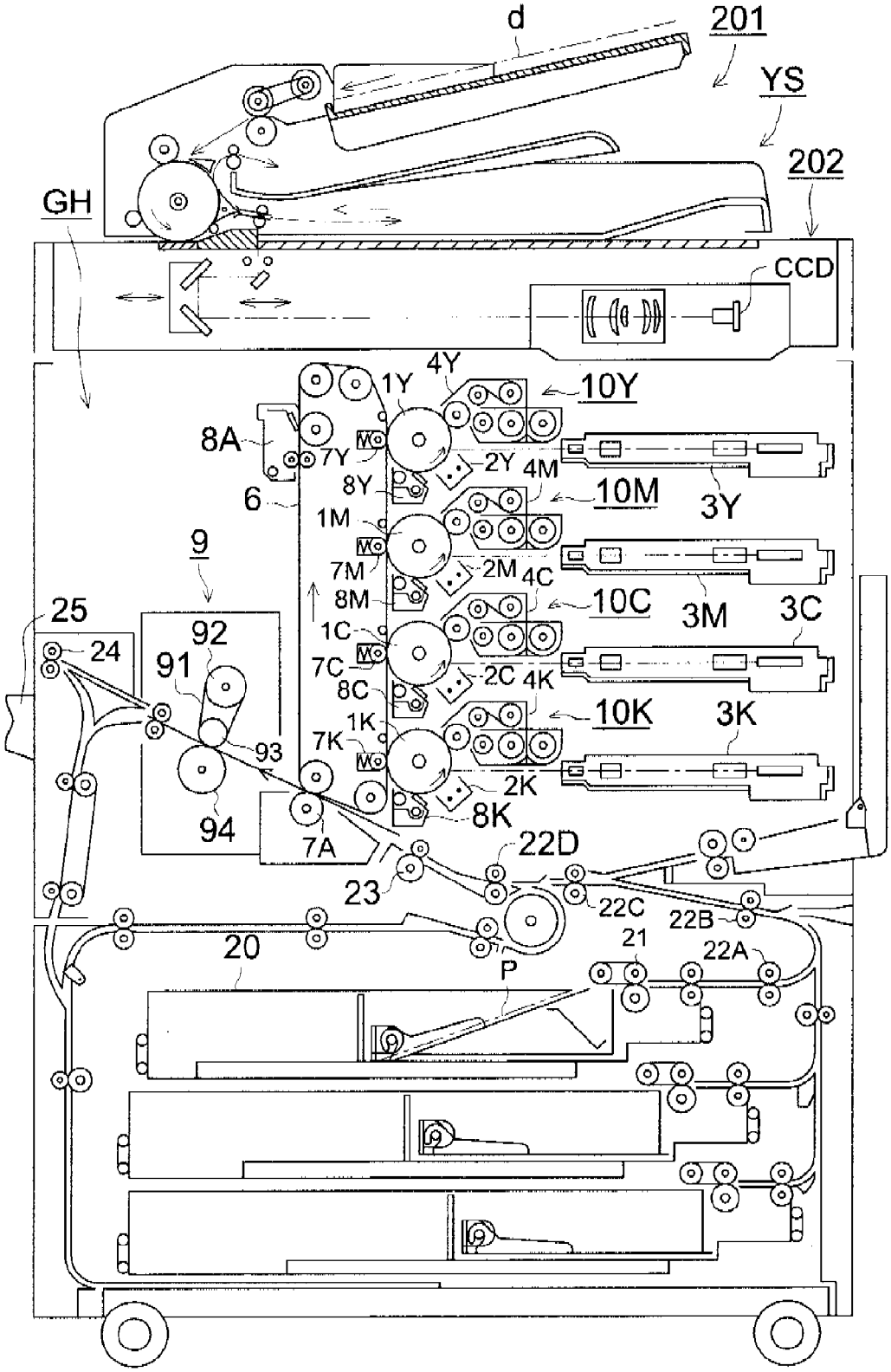
FIG. 1 is a structural diagram of an image forming apparatus.

Embodiments concerning an image forming apparatus of the invention will be described as follows, referring to the drawings.

First, an example of the image forming apparatus will be described based on a structural diagram in FIG. 1.

The image forming apparatus is composed of image forming apparatus main body GH and image reading device YS.

The image forming apparatus main body GH is called a color image forming apparatus of a tandem type which is composed of plural sets of image forming sections 10Y, 10M, 10C and 10K, belt-shaped intermediate transfer body 6, a sheet conveyance device and a fixing device 9.

On the upper portion of the image forming apparatus main body GH, image reading device YS that is composed of automatic document feeding device 201 and document image scanning exposure device 202 is installed. Document d placed on a document table of the automatic document feeding device 201 is conveyed by a conveyance device, then, images on one side of the document d or on both sides thereof are exposed through scanning by an optical system of the document image scanning exposure device 202 to be read into line image sensor CCD.

Signals which have been formed through photoelectric transduction conducted by the line image sensor CCD are subjected to analog processing, A/D conversion, shading correction and image compression processing, and are sent to exposure devices 3Y, 3M, 3C and 3K.

In the image forming section 10Y that forms an image in yellow (Y) color, charging device 2Y, exposure device 3Y, developing unit 4Y and cleaning device 8Y are arranged around photoconductor drum 1Y. In the image forming section 10M that forms an image in magenta (M) color, charging device 2M, exposure device 3M, developing unit 4M and cleaning device 8M are arranged around photoconductor drum 1M. In the image forming section 10C that forms an image in cyan (C) color, charging device 2C, exposure device 3C, developing unit 4C and cleaning device 8C are arranged around photoconductor drum 1C. In the image forming section 10K that forms an image in black (K) color, charging device 2K, exposure device 3K, developing unit 4K and cleaning device 8K are arranged around photoconductor drum 1K. Latent image forming devices are composed of charging device 2Y, exposure device 3Y, charging device 2M, exposure device 3M, charging device 2C, exposure device 3C, charging device 2K and exposure device 3K.

Incidentally, each of the developing units 4Y, 4M, 4C and 4K contains two-component developer composed of carrier and small diameter particle toner in each of yellow (Y), magenta (M), cyan (C) and black (K) colors.

The intermediate transfer body 6 is wound around plural rollers, and is driven to circulate.

Fixing device 9 has therein endless fixing belt 91 that is wound around heat roller 92 and pressure roller 93 to be driven to circulate and an outer pressure roller 94 that presses the pressure roller 93 through the fixing belt 91, and the fixing device 9 fixes a toner image on recording material (recording sheet) P through heating and pressing in a nip portion formed between the fixing belt 91 and the outer pressure roller 94.

Images formed by image forming sections 10Y, 10M, 10C and 10K in each color respectively, are transferred (primary transfer) one by one on rotating intermediate transfer body 6 respectively by transfer devices 7Y, 7M, 7C and 7K, thus, a toner image of composite color images is formed. Recording P material P stored in sheet feed cassette 20 is fed by sheet feeding device 21 and is conveyed to transfer device 7A through sheet-feed rollers 22A, 22B, 22C, 22D and registration roller 23, and a color image is transferred onto recording material P (secondary transfer). The recording material P on which the color image has been transferred is heated and pressed in fixing device 9, and the color toner image is fixed on the recording material P. After that, the recording material P is interposed between sheet ejection rollers 24 to be placed on sheet ejection tray 25 outside the apparatus.

On the other hand, after the color image is transferred onto the recording material P by the transfer device 7A, intermediate transfer body 6 from which the recording material P has been curvature-separated is cleaned by cleaning device 8A so that residual toner may be removed.

Incidentally, though the foregoing is for the image forming apparatus for forming a color image, the invention can also be applied to an image forming apparatus for forming a black-and-white image.

Next, a fixing device 9 relating to the invention will be described based on a sectional view in FIG. 2.

The fixing belt 91 is formed to be endless, and for example, PI (polyimide) having a thickness of 70 μm or nickel electroformed having a thickness of 40 μm is used, and an outer circumferential surface of the basic body is covered with a heat-resistant silicone rubber (hardness JIS-A30°) having a thickness 200 μm as an elastic layer, and it is further covered with a tube of PFA (perfluoroalkoxy) representing heat-resistant resin having a thickness of 30 μm. Meanwhile, a dimension of an inside diameter is 80 mm, for example.

Heat roller 92 has therein built-in halogen lamp 92A representing a heating device that heats fixing belt 91, and for example, an outer circumferential surface of cylindrical core metal 92B that is made of aluminum and has its wall thickness of 2 mm is covered with resin layer 92C that is coated with PFA whose thickness is 30 μm. Incidentally, a dimension of an outside diameter is, for example, 52 mm.

As halogen lamp 92A, a portion of 930 W and a portion of 600 W are provided to make heat distribution different in the axial direction, to cope with different sheet widths.

In pressure roller 93, solid core metal 93A made of metal such as iron is covered with silicone rubber (hardness JIS-A10°) representing heat resistant solid rubber and having a thickness of 7 mm as elastic layer 93B, and it is further covered with resin layer 93C coated with PFA representing a low-friction and heat resistant resin with a thickness of 30 μm. Incidentally, a dimension of an outside diameter is, for example, 40 mm. It is also possible to use fluororubber in place of silicone rubber.

Outer pressure roller 94 (pressure member) has therein built-in halogen lamp 94A representing a heating device that heats fixing belt 91, and an outer circumferential surface of cylindrical core metal 94B that is made of aluminum or the like and has its wall thickness of 2 mm is covered by heat resistant silicone rubber (hardness JIS-A20°) as an elastic layer 94C, and it is further covered by resin layer 94D of PFA tube having a thickness of 30 μm. Incidentally, a dimension of an outside diameter, for example, is 50 mm.

Owing to an unillustrated biasing device, the outer pressure roller 94 causes fixing belt 91 to come in pressure contact with pressure roller 93.

As halogen lamp 94A, the power is 530 W, for example, and it has a uniform light distribution.

There are further provided temperature sensor S1 that detects a temperature at the portion where the fixing belt 91 is wound around, temperature sensor S2 that detects a temperature of the fixing belt 91 immediately before nip portion N and temperature sensor S3 that detects a temperature of the outer pressure roller 94.

Meanwhile, it is also possible to form resin layers 92C, 93C and 94D through covering of a tube of PTFE (polytetrafluoroethylene) or through coating processing thereof.

Any type of a heating device can also be used, as a heating device that heats fixing belt 91, and for example, an induction heating element employing an exciting coil can be used. In addition, a heating device does not always need to be arranged in heat roller 92, and it may be arranged anywhere.

Further, the fixing device may also be equipped with a tension roller that presses a fixing belt.

In the aforesaid structure, when pressure roller 93 is rotated clockwise by an unillustrated driving device, fixing belt 91 and heat roller 92 are also rotated clockwise, while, outer pressure roller 94 rotates counterclockwise. The outer pressure roller 94 may also be driven. Further, fixing belt 91 that comes in contact with heat roller 92 is heated by halogen lamp 92A, and the outer pressure roller 94 is also heated by halogen lamp 94A. Then, since the outer pressure roller 94 is biased in the direction of pressure roller 93 by an unillustrated biasing device, the fed recording material P is heated and pressed and the toner image on the recording material P is fixed in nip portion N between fixing belt 91 wound around pressure roller 93 and outer pressure roller 94.

Figure 2:
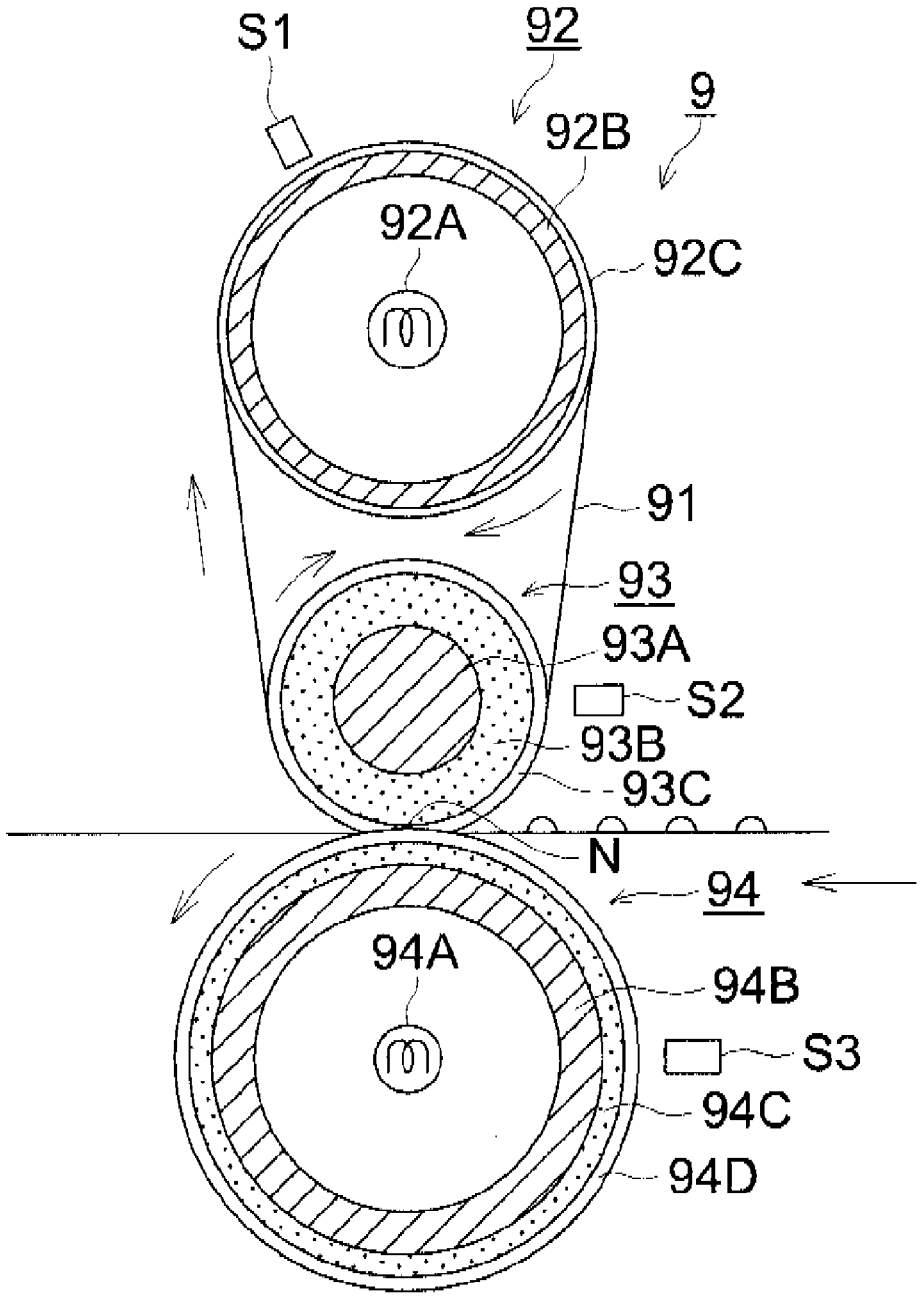
FIG. 2 is a sectional view of a fixing device.

In the fixing device shown in FIG. 2, heat roller 92 is positioned directly above pressure roller 93, and nip portion N is formed on a straight line passing through a center of the heat roller 92 and a center of the pressure roller 93. However, it is not necessary to be limited to this, and it is also possible to arrange so that the heat roller 92 is located on the side of pressure roller 93, and nip portion N is formed on the portion that is not on the straight line.

In this case, in the nip portion N, resin layer 93C and elastic layer 93B of pressure roller 93 are extended in the circumferential direction by the pressure of outer pressure roller 94. Owing to this, cracks are generated on resin layer 93C, and there is possibility that stresses are concentrated on elastic layer 93B where cracks have been generated, and cracks are generated even on the elastic layer 93B, resulting in destruction.

Figure 3:
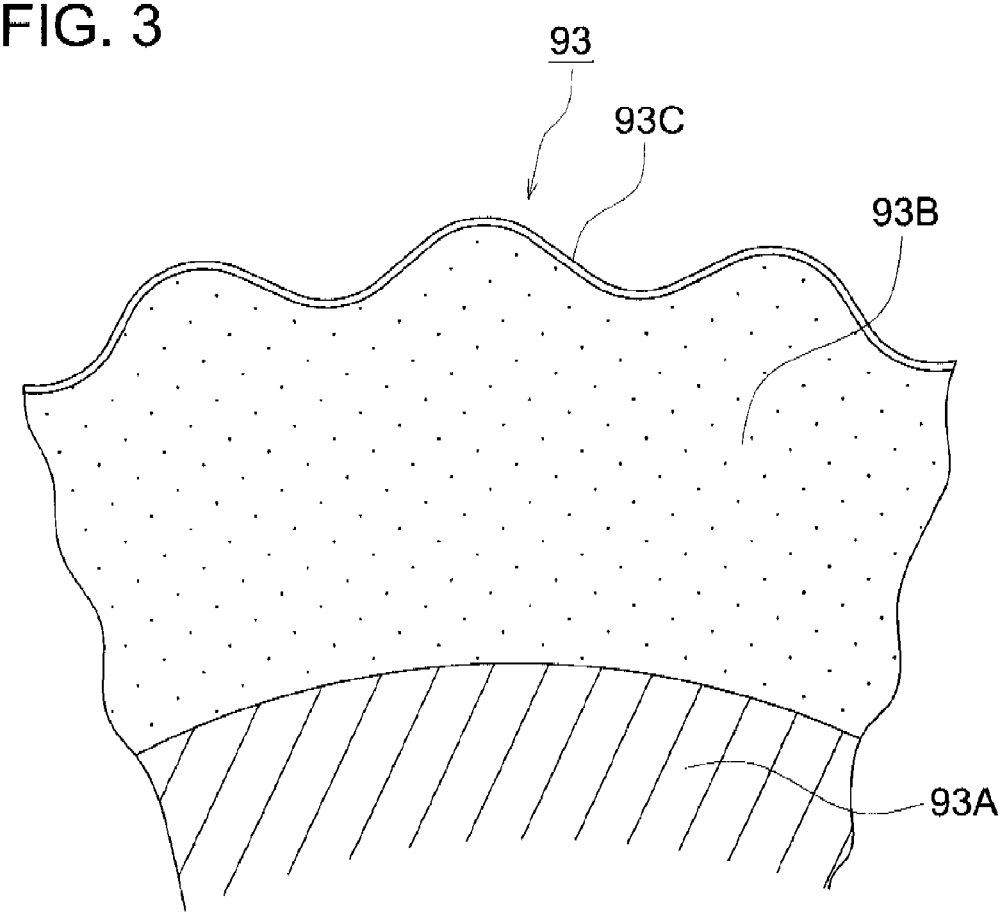
FIG. 3 is an enlarged diagram of a resin layer.

To solve this problem, plural undulations are formed on resin layer 93C and elastic layer 93B along the circumferential direction of an outer circumferential surface of pressure roller 93, as shown in an enlarged diagram of pressure roller 93 in FIG. 3, and each of the undulations is formed in parallel with an axial direction. In other words, an outer circumferential surface of pressure roller 93 is formed in a wave form. Owing to this, these undulations become flat substantially along a shape of nip portion N even when the outer circumferential surface of pressure roller 93 is extended in the circumferential direction, thus, no cracks are generated on resin layer 93C because no extending force is applied on resin layer 93C.

It is preferable that a wave length is 5 mm or less and amplitude is 1 mm or less in terms of a dimension of wave-formed undulations. Therefore, a wave height (step of undulations) is much greater than a thickness of resin layer 93C.

The undulations of pressure roller 93 are formed by transferring a surface form of roller injection mold having undulations. A mold is formed around a mother mold on which the undulations are formed on the surface, and then, the mother mold is removed to obtain the roller injection mold. It is also possible to form undulations by plural molds which are divided in the circumferential direction and are separated in the direction of normal lines.

Dimensions of undulations of pressure roller 93 are determined based on the following conditions. That is, when an effective circumferential length along undulations is represented by A, an average circumferential length corresponding to an average outside diameter is represented by B and an outer circumferential elongation percentage representing a rate at which an outer circumferential surface of the elastic layer 93B of pressure roller 93 is extended at nip portion N is represented by C, the following conditional expression is made to be satisfied.

$$A/B \approx C$$

Since the outer circumferential elongation percentage C varies depending on a roller outside diameter, physical properties of rubber, a rubber thickness and pressure force at a nip portion, undulations are designed by measuring outer circumferential elongation percentage C in advance, and by obtaining effective circumferential length A by multiplying outer circumferential elongation percentage C by average circumferential length B. For measurement of outer circumferential elongation percentage C, it is possible to obtain a ratio of a conveyance speed of a recording sheet to an amount of rotations of the pressure roller by using a fixing device wherein a shape of a pressure roller alone is of the ordinary circular sectional form and other conditions are exactly the same. To be specific, when E represents a conveyance speed of recording sheet under the condition of amount of rotation of pressure roller D=π×long diameter of pressure roller×angular rotation speed, the outer circumferential elongation percentage C is as follows.

$$C=E/D$$

When a pressure roller having no resin layer is used, the accuracy of measurement can be improved.

When a form of wave-formed undulations is close to a sine wave, a ratio of effective circumferential length A to average circumferential length B is determined by a wavelength and an amplitude, and when a ratio of effective circumferential length A to average circumferential length B is 1.05, an amplitude should be made to be about 0.17 times the wavelength, and when a ratio of effective circumferential length A to average circumferential length B is 1.10, an amplitude should be made to be about 0.23 times the wavelength. Further, even if a waveform is different from a sine wave slightly, this value does not change greatly.

In addition, when a wavelength and an amplitude are too large, uneven pressure distribution is generated in nip portion N, and band-shaped uneven gloss tends to be generated. Therefore, a small wavelength and a small amplitude are preferable. However, if they are too small, injection processing into a mold is difficult.

Further, if forms of undulations are smooth like a sine wave, various types of waveforms can be applied. Further, they do not always need to be regular. However, waveforms having a large curvature partially such as a triangle wave and a cycloid are inappropriate, because uneven pressure distribution is generated in the nip portion, and it appears on an image.

Continuous sheet feeding was conducted by using fixing device 9 described by referring to FIG. 2, after forming undulations on pressure roller 93 as stated above.

Experimental conditions are as follows.

Resin layer thickness of pressure roller: 30 μm

Undulations on pressure roller: A shape close to a sine wave having a wavelength of 3 mm, amplitude of 0.5 mm Ratio of effective circumferential length A to average circumferential length B of pressure roller: 1.05 (measured by the aforesaid method)

Fixing load: 700N

Fixing belt tension: 42N

Sheet feeding speed: 150-300 mm/s

Fixing belt control temperature: 150-210° C.

Pressure roller control temperature: 120-160° C.

Number of sheets having passed: 600,000 sheets

No problem was caused at all in these experiments.

Since grinding and polishing processing was difficult for rubber with low hardness, rubber injection was conducted to a mold having a wave-shaped inner circumferential surface, and coating was carried out after removing from a mold. However, the invention is not limited to this manufacturing method. If it is possible to cause a tube to stick fast to a mold through vacuum attraction or the like, it is also possible to use a tube as a resin layer.

In addition, though an outer circumferential surface of pressure roller 93 is changed by undulations in the circumferential direction, it is not changed in the axial direction, and every cross-section shows the same form. However, the form may also be one wherein undulations are changed in a spiral manner. In this case, it is sufficient if changes of undulations satisfy the aforesaid conditions in the circumferential direction.

In addition to that, undulations of pressure roller 93 may also be smooth granular protrusions. In this case, it is preferable that a distance between protrusions is made to be 5 mm or less, and a step of undulations is made to be 1 mm or less. Granular protrusions are formed by transferring a surface shape having undulations of roller injection mold. For obtaining the roller injection mold, a mold is formed around a mother mold on which the undulations are formed on the surface, and then, the mother mold is removed. It is also possible to form undulations by plural molds which are divided in the circumferential direction and are separated in the direction of normal lines.

Even in the case where undulations are formed as granular protrusions, conditions about effective circumferential length A, average circumferential length B and outer circumferential elongation percentage C are the same as the foregoing.

Further, sheets were fed continuously under the same conditions by making a distance between granular protrusions to be about 3 mm and by making a step of undulations to be about 0.5 mm, and no problem occurred at all.

A belt-type fixing device shown in the aforesaid FIG. 2 is of an upper belt type employing a fixing belt on the image surface side, and it is necessary to enhance a set temperature of a fixing belt, for increasing an amount of supply from the fixing belt in view of thermal efficiency. Thus, a temperature of a pressure roller arranged inside the fixing belt rises inevitably, and an elastic modulus of the elastic layer is lowered. Owing to this, a transformation ratio at the nip portion grows greater and subjects of the invention become further greater, resulting in effects which are especially conspicuous.

However, the belt-type fixing device wherein a plurality of undulations are formed on the pressure roller is not limited to the belt-type fixing device having the structure shown in FIG. 2, and the same effects can also be obtained by a belt-type fixing device in another embodiment. Consequently, FIGS. 4-7 show belt-type fixing devices in other embodiments.

Figure 4:
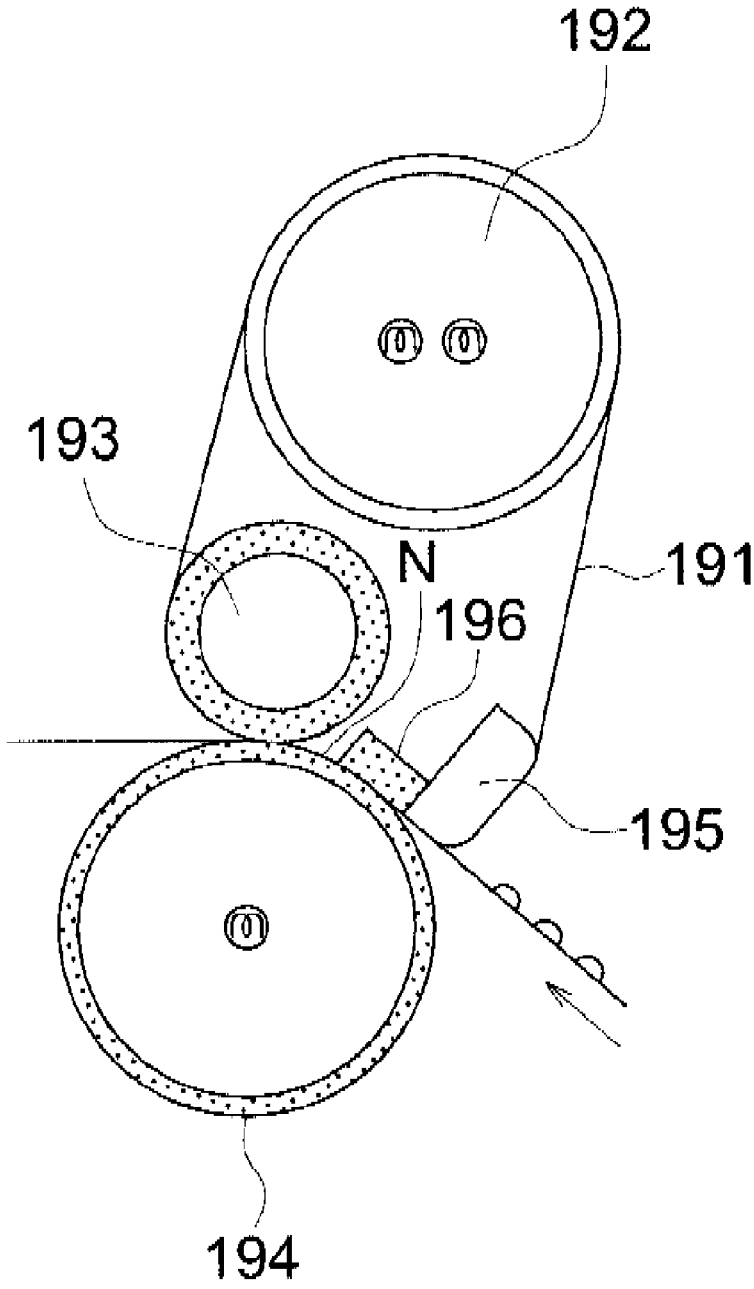
FIG. 4 is a sectional view of a belt-type fixing device of another embodiment.

In the belt-type fixing device shown in FIG. 4, fixing belt 191 is wound around heat roller 192, pressure roller 193 having an elastic layer and a resin layer with prescribed thicknesses and further around guide member 195, and it is supported by an unillustrated supporting member so that a load is applied on outer pressure roller (pressure member) 194. Fixing belt 191 is caused to be in pressure contact with outer pressure roller 194 by pressure pad 196 made of silicone rubber that is arranged between pressure roller 193 and guide member 195 from the inside of the fixing belt 191. Due to this, a width of the nip portion N is further increased. The aforesaid undulations are formed on pressure roller 193. A roller may also be used in place of the pressure pad 196.

Figure 5:
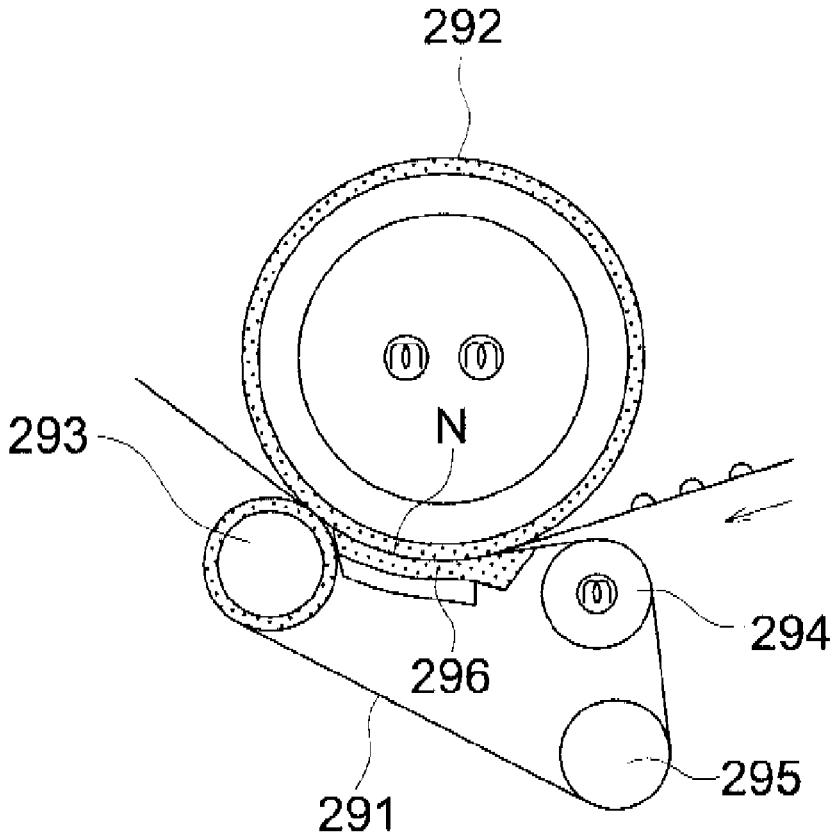
FIG. 5 is a sectional view of a belt-type fixing device of another embodiment.

In the belt-type fixing device shown in FIG. 5, fixing belt 291 is wound around pressure roller 293 having an elastic layer and a resin layer with prescribed thicknesses and is wound around two rollers 294 and 295, and heat roller 292 (pressure member) is in pressure contact with an outer circumferential surface of fixing belt 291. Further, an inner circumferential surface of the fixing belt 291 is held by pressure pad 296. Due to this, a width of the nip portion N is further increased. The aforesaid undulations are formed on pressure roller 293. Further, pressure roller 293 serves as a separation roller that separates a recording material, and effects in the case of forming the aforesaid undulations are great, because a load of the separation roller is high, and a transformation ratio of the elastic layer is also great.

Figure 6:
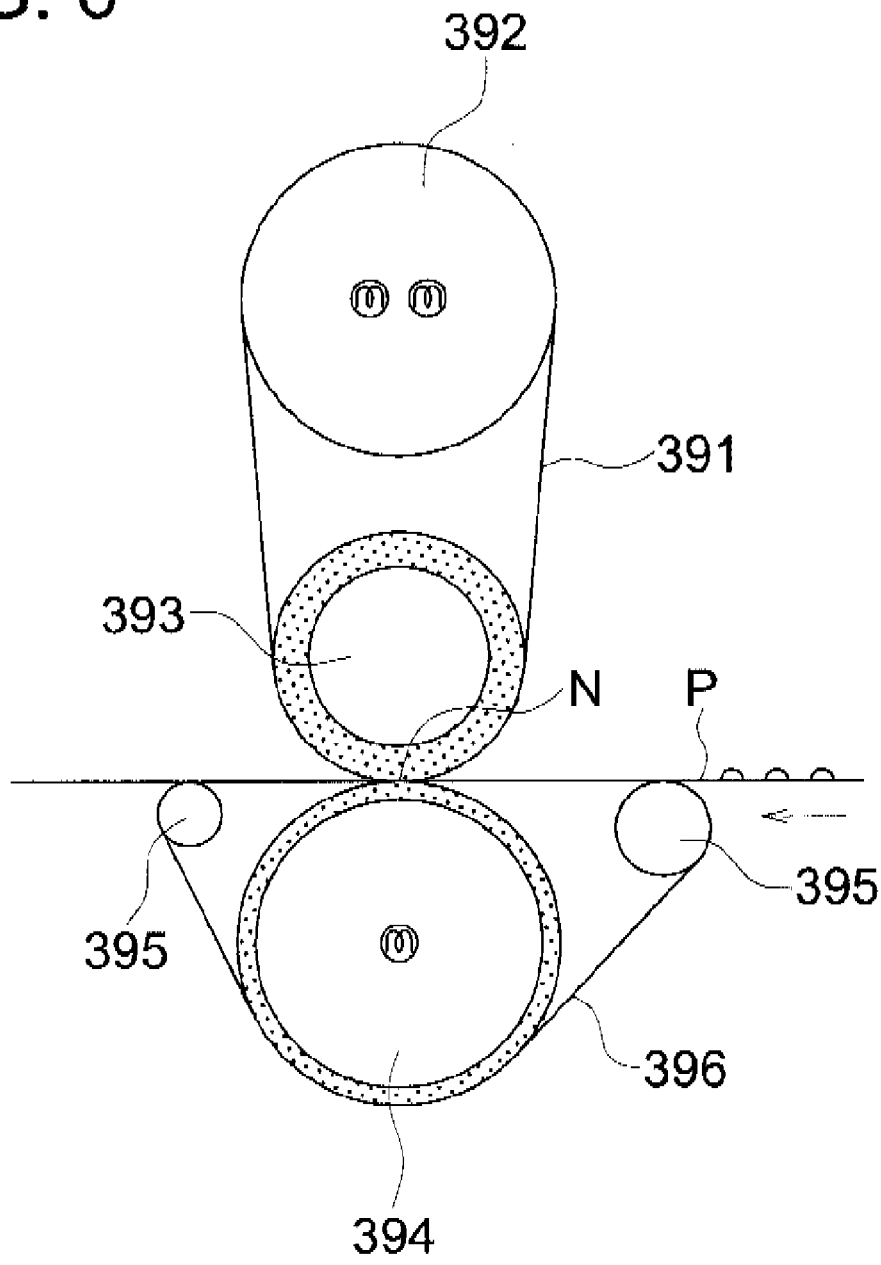
FIG. 6 is a sectional view of a belt-type fixing device of another embodiment.

In the belt-type fixing device shown in FIG. 6, fixing belt 391 is wound around heat roller 392 and around pressure roller 393 on one side, and pressure belt 396 is wound around pressure roller 394 on the other side and around two rollers 395. Each of pressure rollers 393 and 394 has an elastic layer and a resin layer having prescribed thicknesses. Pressure roller 394 presses pressure roller 393 through pressure belt 396 and fixing belt 391. An unfixed image on recording material P is held on pressure belt 396 to be heated in advance in front of nip portion N, thereby, a high fixing characteristic is obtained, and recording material P is conveyed stably by the pressure belt 396 even after passing through the nip portion N. Though pressure roller 394 corresponds to a pressure member against pressure roller 393 in this case, the pressure roller 393 may also be a pressure member against pressure roller 394, and it is desirable that the aforesaid undulations are formed on both of the pressure roller 393 and pressure roller 394.

Further, a pressure pad may be used as a pressure member in place of pressure roller 394.

Figure 7:
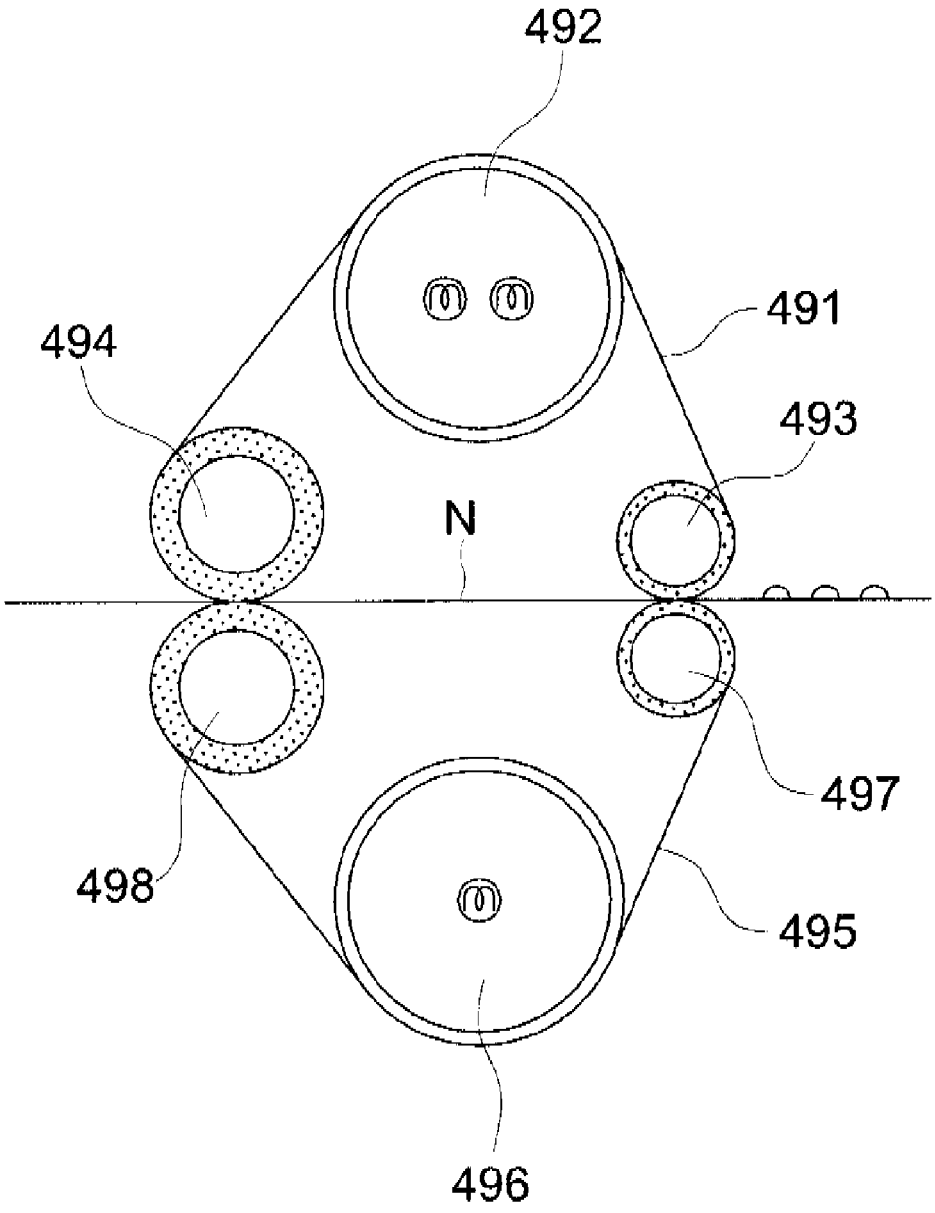
FIG. 7 is a sectional view of a belt-type fixing device of another embodiment.

In the belt-type fixing device shown in FIG. 7, fixing belt 491 is wound around heat roller 492 and two pressure rollers 493 and 494, while, pressure belt 495 is wound around another heat roller 496 and other two pressure rollers 497 and 498. Each of pressure rollers 493, 494, 497 and 498 has an elastic layer and a resin layer with prescribed thicknesses. Then, pressure roller 497 is in pressure contact with pressure roller 493 and pressure roller 498 is in pressure contact with pressure roller 494, respectively through pressure belt 495 and fixing belt 491. Owing to this, a wide width of nip portion N can be secured. A high fixing characteristic and a high separation characteristic are secured at the nip portion N. In this case, the pressure roller 497 corresponds to a pressure member against pressure roller 493, and the pressure roller 498 corresponds to a pressure member against pressure roller 494. However, this may also be reversed, and it is desirable that the aforesaid undulations are formed on pressure rollers 493, 494, 497 and 498.

In the invention, a group of rollers called pressure rollers mean the members for giving pressure to an image on a transfer material such as a recording sheet, and which member is a member to be fixed actually, a member to be biased by a spring to apply a load to a corresponding member, or a member to be moved in the structure accompanied by touching and detaching is not limited.

For example, in the fixing device in FIG. 2, whether pressure roller 93 is fixed and outer pressure roller 94 is biased by a spring, or whether outer pressure roller 94 is fixed and pressure roller 93 is biased by a spring or whether pressure roller 93, fixing belt 91 and heat roller 92 are combined and bias by a spring are not limited for obtaining effects of the invention.

In the aforesaid embodiments, when an elastic layer of a pressure roller in the belt-type fixing device is covered by a resin layer, an effect is exhibited that new cracks affecting adversely are not generated, even when a resin layer or an elastic layer is transformed by pressure in the nip portion.

What is claimed is:

1. A belt-type fixing device comprising:

an endless fixing belt;

a pressure roller arranged inside the fixing belt; and a pressure member which presses the fixing belt against the pressure roller, wherein a toner image on a recording material is fixed in a nip portion formed between the fixing belt and the pressure member, and wherein the pressure roller has an elastic layer which is made of solid rubber and covered by a resin layer, and a plurality of undulations are formed on an outer circumferential surface of the pressure roller in a circumferential direction.

2. The belt-type fixing device of claim 1, wherein when A represents an effective circumferential length along the undulations on the pressure roller, B represents an average circumferential length corresponding to an average outer diameter of the pressure roller and C represents an outer circumferential elongation percentage which is a rate at which an outer circumferential surface of the elastic layer of the pressure roller is extended in the nip portion, an equation A/B=C is satisfied.

3. The belt-type fixing device of claim 2, wherein when a rotation amount of the pressure roller D representing by an equation D=π×(a long diameter of the pressure roller)×(an angular rotation speed of the pressure roller), a conveyance speed of the recording material E and the outer circumferential elongation percentage C satisfies an equation C=E/D.

4. The belt-type fixing device of claim 1, wherein the undulations are formed to be similar to a sine wave.

5. The belt-type fixing device of claim 1, wherein the undulations are formed to be granular protrusions.

6. An image forming apparatus having the belt-type fixing device of claim 1.

* * * * *